US006736208B2

(12) United States Patent
Riddell et al.

(10) Patent No.: US 6,736,208 B2
(45) Date of Patent: May 18, 2004

(54) WELLHEAD PRODUCTION PUMPING TREE WITH ACCESS PORT

(75) Inventors: Daniel J. Riddell, Edmonton (CA); Kwong-Onn Chan, Edmonton (CA)

(73) Assignee: Stream-Flo Industries LTD, Edmonton (CA)

( * ) Notice: Subject to any disclaimer, the term of this patent is extended or adjusted under 35 U.S.C. 154(b) by 0 days.

(21) Appl. No.: 10/128,406

(22) Filed: Apr. 23, 2002

(65) Prior Publication Data

US 2003/0196792 A1 Oct. 23, 2003

(51) Int. Cl.[7] ..... E21B 34/02
(52) U.S. Cl. ..... 166/88.4; 166/65.1
(58) Field of Search ..... 166/65.1, 88.4, 166/75.13, 93.1, 95.1, 97.1

(56) References Cited

U.S. PATENT DOCUMENTS 3,050,126 A * 8/1962 LeBeaux et al. ..... 166/97.1
3,437,149 A * 4/1969 Cugini et al. ..... 166/88.1
4,154,302 A * 5/1979 Cugini ..... 166/65.1
4,804,045 A * 2/1989 Reed ..... 166/65.1
5,544,707 A * 8/1996 Hopper et al. ..... 166/382
5,873,415 A * 2/1999 Edwards ..... 166/344
5,992,527 A * 11/1999 Garnham et al. ..... 166/88.4
6,062,314 A * 5/2000 Nobileau ..... 166/88.4
6,176,316 B1 * 1/2001 Hart ..... 166/368
6,302,212 B1 * 10/2001 Nobileau ..... 166/88.4
6,457,530 B1 * 10/2002 Lam et al. ..... 166/88.4
6,470,968 B1 * 10/2002 Turner ..... 166/348

FOREIGN PATENT DOCUMENTS

CA 2197584 A * 4/1997 ..... E21B/33/06

* cited by examiner

*Primary Examiner*—David Bagnell
*Assistant Examiner*—Brian Halford
(74) *Attorney, Agent, or Firm*—Dennis T. Griggs

(57) ABSTRACT

In an integral production pumping tree, the bottom connection, blow-out preventer, flow tee and top connection are positioned to one side, with the vertical rod bore off-center. Up to three vertical ports are provided in the other side of the tree, for providing access to the production casing bore for an electric heating string, an instrumentation string and a small diameter injection tubing string. The ports accommodate sealed connection assemblies, from which the strings extend. The upper portion of the other side of the tree is cut away to create space for introducing the connecting assemblies. The tubing hanger is provided with matching bores.

11 Claims, 4 Drawing Sheets

WELLHEAD PRODUCTION PUMPING TREE WITH ACCESS PORT

CROSS-REFERENCE TO RELATED APPLICATIONS

Not applicable.

STATEMENT REGARDING FEDERALLY SPONSORED RESEARCH OR DEVELOPMENT

Not applicable.

FIELD OF THE INVENTION

The present invention relates to a wellhead production pumping tree and to providing in it one or more access ports for accommodating connection assemblies for electrical heating and instrumentation strings.

BACKGROUND OF THE INVENTION

It is common today to produce heavy oil from reservoirs formed of unconsolidated sands. This type of production is often associated with problems or issues such as:

- wax formation clogging the upper end of the tubing string;
- injection of steam into the reservoir to heat the oil, which often makes it desirable to monitor reservoir conditions, such as temperature and pressure, from the production wells; and
- the use of down hole progressive cavity pumps for moving the heavy oil to surface—these pumps are driven by rotating rod strings powered by motor and drive assemblies mounted on top of the pumping tree. These assemblies vibrate and apply stresses to the pumping tree that can cause it to part, particularly at threaded connections.

The oil industry has developed solutions to these problems in various ways, including:

- using an electrical heating cable or string, in contact with the upper end of the production tubing, to apply heat to the oil passing there through to reduce the formation of wax;
- running a small diameter string of tubing into the production casing bore to circulate out sand; and
- running or permanently providing an instrumentation string, typically a cable with attached sensors, in the production casing bore when measurements are to be taken.

These 'strings' are referred to herein as 'supplemental strings'.

A pumping tree is an assembly mounted to the upper end of a wellhead tubing head. For many years it consisted of a stack of separate components threaded together and forming a central vertical bore extending there through, the components being:

- an adapter comprising a bottom flange, for bolting to the tubing head flange, narrowing down to a threaded top connection of smaller diameter;
- a production blow-out preventer ("B.O.P.") having a body forming opposed horizontal openings, in which are located the ram components, and having bottom and top threaded connections; and
- a flow tee body forming a horizontal side outlet and having top and bottom threaded connections.

More recently the housing of the production pumping tree has been cast or forged as a single integral unit. As a result, the threaded connections have been eliminated and the tree has only top and bottom connections, which are typically flanged or studded. The height of the unit is reduced and the side walls are thicker. This product, disclosed in Canadian Patent No. 2,197,584, issued to the present applicants, has alleviated the parting problem arising from mounting the high r.p.m., heavy, vibrating, off-center rod rotating drive assembly on the tree.

BRIEF SUMMARY OF THE INVENTION

In broad form, the present invention is directed to an integral production pumping tree whose housing forms a vertical production tubing bore and openings for receiving a well head flow control component such as a horizontal blow-out preventer (B.O.P) valve and flow tee openings, all located off-center in one side section of the housing, and at least one off-center vertical access bore formed in the other side section.

The word 'off-center' is intended to indicate that the production tubing bore axis and the access bore axis are each spaced laterally or offset from the central axis of the pumping tree.

The pumping tree is preferably combined with a tubing hanger, to be used in the wellhead tubing head, which also forms vertical off-center bores corresponding or coinciding with those of the pumping tree.

A detailed and preferred embodiment of the invention comprises:

- a production pumping tree having an integral housing having first and second sections;
- the housing forming an off-center vertical production tubing bore and off-center horizontal B.O.P. and flow tee openings in the first section and at least one off-center vertical access bore in the second section; and
- an upper portion of the second section more preferably being partly or entirely cut-away, to provide space for connecting a supplemental string to extend through an access bore.

Broadly stated, the invention is directed to a production pumping tree for use in a wellhead, comprising: a housing formed from a single piece of steel and having first and second sections; the first housing section forming an off-center vertical production tubing bore connected with horizontal blow-out preventer component openings and a horizontal flow tee opening; the second housing section forming at least one access bore for enabling access through the housing for a supplemental string.

DETAILED DESCRIPTION OF THE INVENTION

Figure 1:
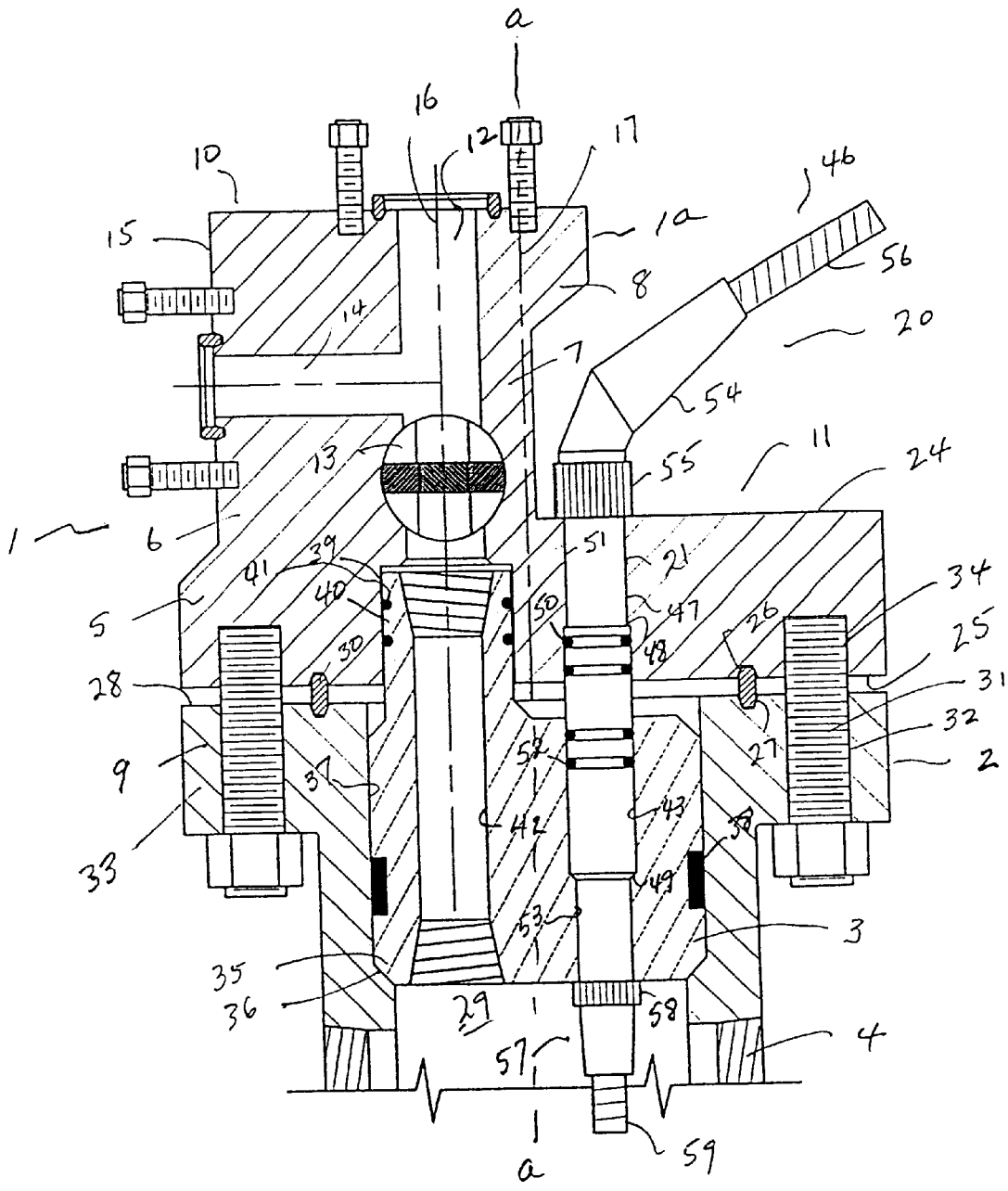
FIG. 1 is a sectional side elevation, taken along line I—I in FIG. 2 showing the pumping tree, tubing head and hanger, with a power feed through assembly extending through coincident access bores in the pumping tree and tubing hanger for extension into the production casing bore.
Figure 2:
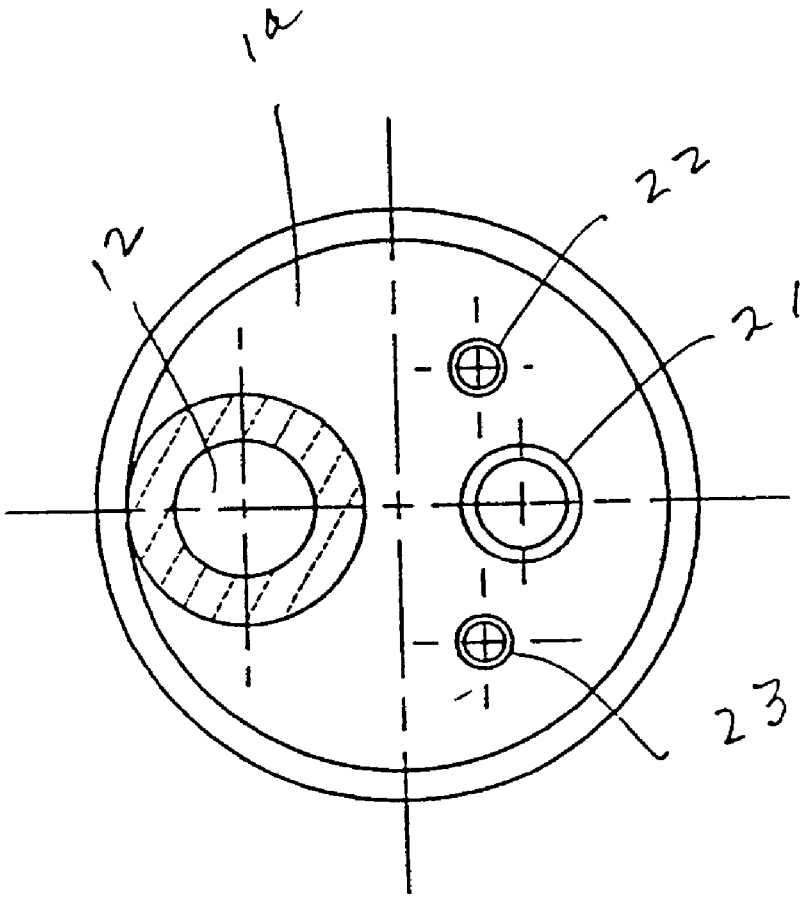
FIG. 2 is a top plan view of the pumping tree.

Having reference to the FIGS., a pumping tree 1 is shown mounted on a wellhead tubing head 2 supporting a tubing hanger 3. The tubing head 2 is connected with production casing (not shown).

The pumping tree housing 1*a* is "integral" or formed of one piece of steel. It comprises a bottom connection 5, a B.O.P. housing 6, a flow tee housing 7 and a top connection 8. The bottom connection 5 is adapted to mate directly with the flanged top connection 9 of the tubing head 2. The top connection 8 is adapted to mate with a stuffing box (not shown) or the bottom frame of a rotary drive assembly (not shown).

For purposes of this specification, the pumping tree housing 1*a* is considered to be divided into first and second halves or sections 10, 11 by an imaginary line a—a, coinciding with the center axis 17 of the pumping tree, as shown in FIG. 1.

The first section 10 forms a vertical production tubing bore 12, opposed B.O.P. ram component openings 13 and a flow tee opening 14. The horizontal openings 13, 14 extend between the tree housing side surface 15 and the bore 12.

It is to be noted that the axis 16 of the bore 12 is "off-center" or spaced laterally to the left of the central axis 17, as shown in FIG. 1.

The tree housing 1*a* is not symmetrical, in that an open space or "cut-away" 20 is left above the second section of the bottom connection 5.

The second section bottom connection 5 forms three spaced apart, vertical access ports 21, 22, 23 extending between its top and bottom surfaces 24, 25.

The tree housing 1*a* has a circular seal groove 26 formed in its bottom surface 25. The tubing head 2 has a matching seal groove 27, formed by its top surface 28 and extending around its central bore 29. A seal ring 30 is seated in the grooves 26, 27 to seal the tree housing 1*a* to the tubing head 2.

Bolts 31 extend through bolt holes 32 in the tubing head flange 33 and into threaded holes 34 in the tree housing bottom connection 5, to secure the tubing head 2 and tree housing 1*a* together.

A tubing hanger 3 is positioned in the tubing head bore 29. It is supported at its base 35 by an internal shoulder 36 of the tubing head 2. The tubing hanger 3 is sealed to the tubing head bore surface 37 by a ring seal 38. The bottom surface 25 of the tree housing 1*a* is cylindrically recessed to form a "pocket" 39. The tubing hanger 3 has an upwardly extending neck 40, carrying seals 41, which is received in the pocket 39. The tubing hanger 3 forms a vertical bore 42 which registers with the bore 12 of the tree housing 1*a*. The tubing hanger 3 further forms vertical ports 43, 44, 45 which register with the ports 21, 22, 23. Reception of the neck 40 in the pocket 39 keys or properly locates the tree housing rod bore 12 and the access ports 21, 22, 23 with the corresponding bore 42 and ports 43, 44, 45 of the tubing hanger 3.

An electrical power feed through assembly 46 is associated with the power access ports 21, 43. More particularly, the assembly 46 comprises a tubular power mandrel 47 having top and bottom threads (not shown). The mandrel 47 is held in place in the access ports 21, 43 by shoulders 48, 49 formed by the surfaces 51, 53 of the access ports.

The power mandrel 47 carries O-ring seals 50, for sealing against the bore surface 51 of the tree housing power access port 21, and O-ring seals 52 for sealing against the bore surface 53 of the hanger power access port 43. An upper power supply pigtail 54, having a connector 55, is attached by the connector to the upper threaded end of the power mandrel 47. The pigtail 54 is also connected with a power supply cable 56. A lower pigtail 57, having a connector 58, is attached to the lower threaded end of the power mandrel 47. The lower pigtail 57 is, in turn, connected with a heat trace cable 59.

Figure 3:
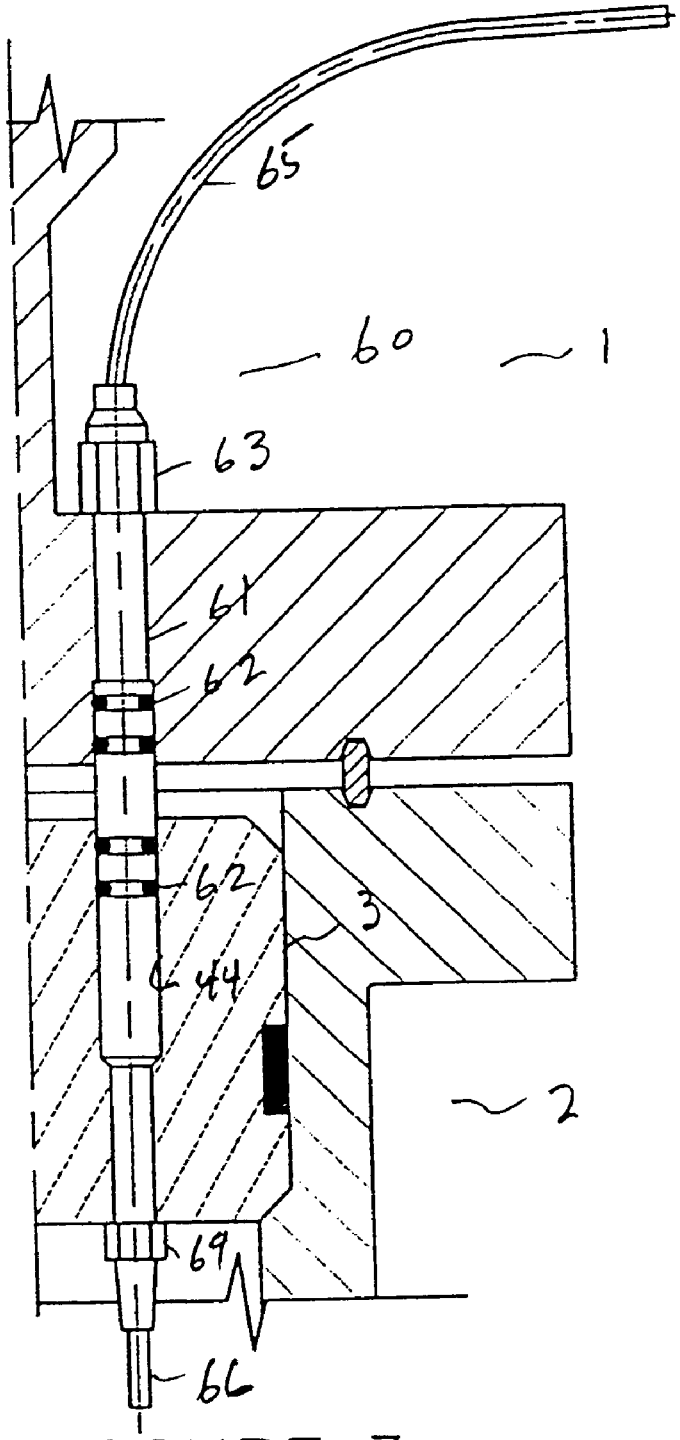
FIG. 3 is a sectional side elevation of the second section of the pumping tree, taken along the line III—III of FIG. 2, showing an instrumentation string extending through coincident access bores in the pumping tree and tubing hanger.

An instrumentation feed through assembly 60 is associated with the instrumentation access ports 22, 44, as shown in FIG. 3. The instrumentation assembly 60 is similar in connection end arrangement to the power assembly 46. More particularly, it comprises a mandrel 61, carrying seals 62, and top and bottom connectors 63, 64 connecting the mandrel 61 with instrumentation cables 65, 66.

Figure 4:
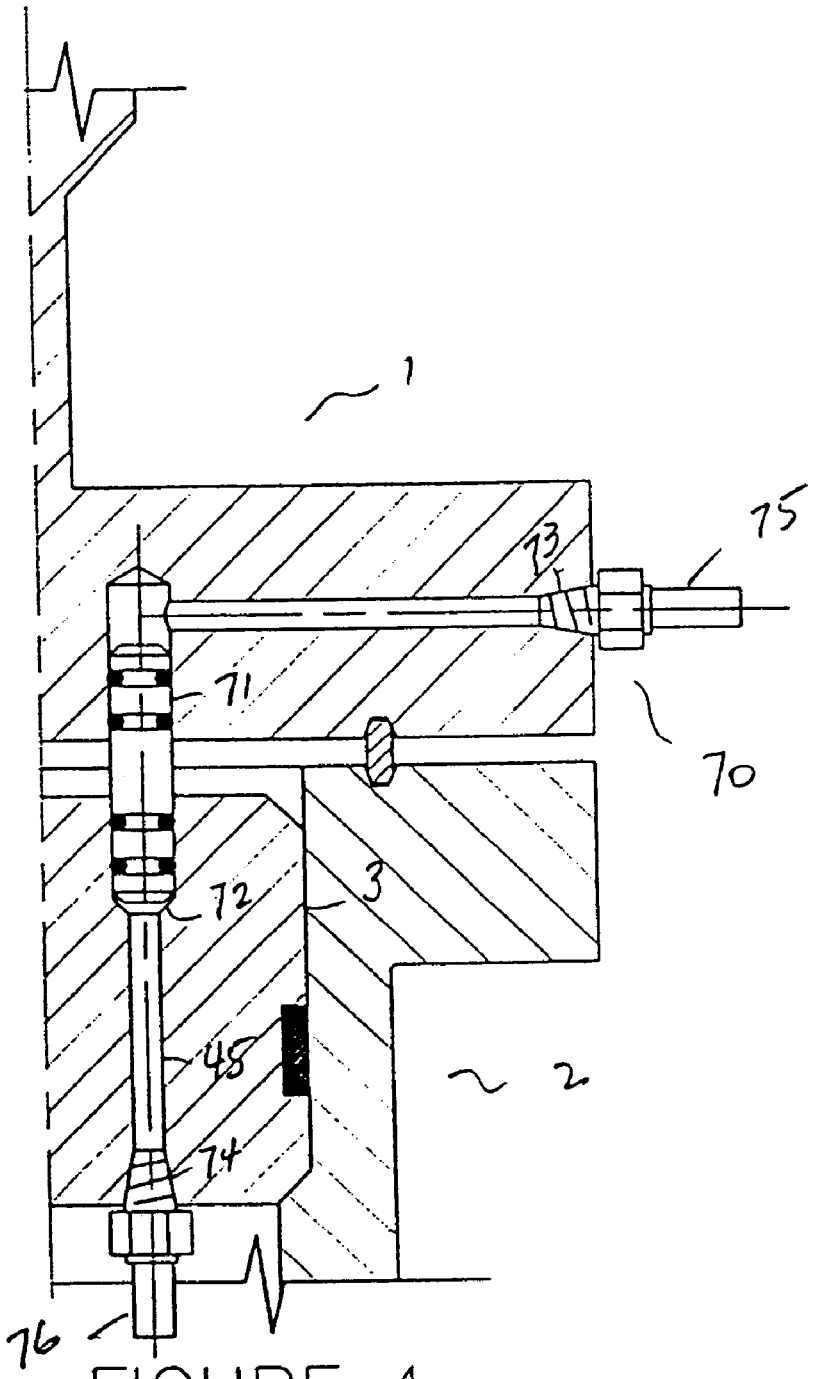
FIG. 4 is a sectional side elevation of the second section of the pumping tree, taken along the line IV—IV of FIG. 2, showing a circulation string extending through coincident access bores.
Figure 3:
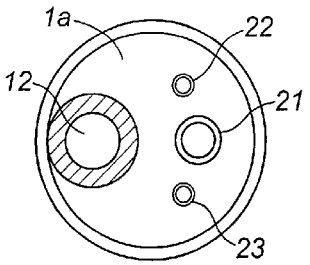
Figure 3:
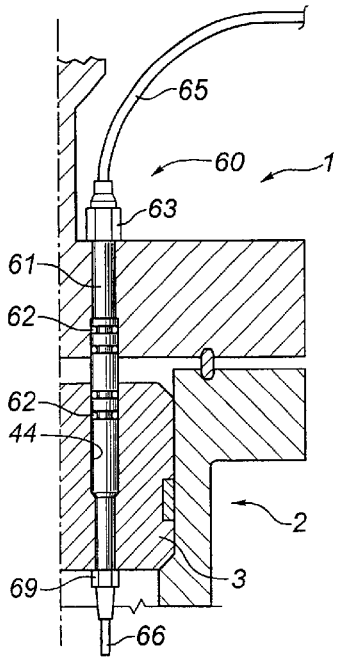
Figure 4:
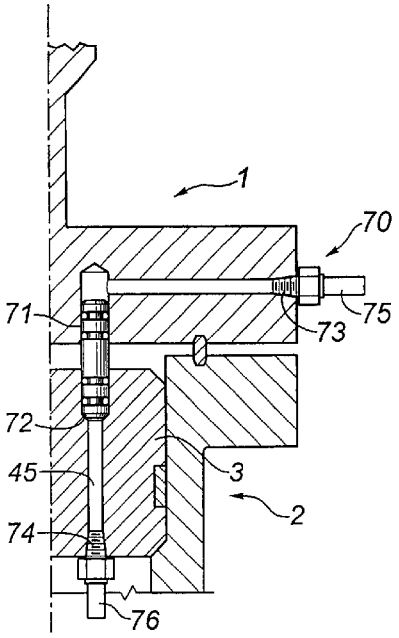

A hydraulic feed through assembly 70 is associated with the access ports 23, 45, as shown in FIG. 4. The hydraulic assembly 70 comprises a sealed tube assembly 71 extending through the ports 23, 45 and held in place by the tubing head shoulder 72. The tube assembly 71 has threaded ends 73, 74 for connection with tubing 75, 76, for chemical injection or hydraulic control of a down hole tool or valve

We claim:

1. A production pumping tree for use in a wellhead, comprising:

a housing formed from a single piece of steel and having first and second sections;

the first housing section forming an off-center vertical production tubing bore connected with openings for receiving a well head flow control component and a horizontal flow tee opening; and the second housing section forming a plurality of access bores providing a plurality of access ports for enabling access through the housing for a plurality of supplemental strings.

2. The pumping tree as set forth in claim 1 comprising:

an electrical power feed through assembly extending through one of the access ports.

3. The pumping tree as set forth in claim 1 wherein:

at least part of the upper portion of the second section is cut-away to provide space for receiving a supplemental string.

4. A production pumping tree as set forth in claim 1, wherein the well head flow control component comprises a blow-out preventer (B.O.P.) valve.

5. A production pumping tree as set forth in claim 1, wherein the pumping tree has a central axis, and the axis of the production tubing bore and the axis of the each access bore are each spaced laterally or offset from the central axis of the pumping tree.

6. A production pumping tree as set forth in any one of claims 1, 2, or 3, including a tubing hanger, to be used in the wellhead tubing head, which forms vertical off-center bores matching or coinciding with those of the pumping tree.

7. An improved production pumping tree comprising an integrally formed pumping tree housing providing a bottom connection, connections for a blow-out preventer, a flow tee and a top connection on one side of the housing, with an off-center vertical rod bore and access ports being formed in the other side of the housing for providing access into a production casing bore for receiving a plurality of supplemental strings including an electric heating string, an instrumentation string and a small diameter injection tubing string.

8. An improved production pumping tree as set forth in claim 7, wherein the access ports are coupled to sealed connecting assemblies from which one or more of the supplemental strings can be extended.

9. An improved production pumping tree as set forth in claim 8, wherein one portion of the tree housing is cut away to create space for introducing the sealed connecting assemblies.

10. A production pumping tree for use in a wellhead, comprising:

a housing formed from a single piece of steel and having first and second sections;

the first housing section forming an off-center vertical production tubing bore connected with openings for receiving a flow control component and a horizontal flow tee opening;

the second housing section forming a plurality of access bores for enabling access down through the housing;

an electrical power feed through assembly extending through one access bore;

at least part of the upper portion of the second section being cut-away to accommodate the electrical power feed through assembly; and the remaining access bore being available to receive a supplemental string.

11. A production pumping tree comprising:

an integrally formed pumping tree housing providing a bottom connection, a blow-out preventer housing, a flow tee housing and a top connection on one side of the housing; and the other side of the housing forming three access ports for receiving an electric heating string, an instrumentation string and an injection tubing string.

* * * * *

UNITED STATES PATENT AND TRADEMARK OFFICE

CERTIFICATE OF CORRECTION

PATENT NO. : 6,736,208 B2
DATED : May 18, 2004
INVENTOR(S) : Daniel J. Riddell

It is certified that error appears in the above-identified patent and that said Letters Patent is hereby corrected as shown below:

The title page shoule be deleted and substutute therefore the attached title page, as shown on the attached page.

Delete drawings sheets 1-4, and substitute therefore the drawing sheets, consisting of Figs. 1-4, as shown on the attached pages.

Signed and Sealed this

Fourteenth Day of September, 2004

JON W. DUDAS
*Director of the United States Patent and Trademark Office*

(12) United States Patent
Riddell et al.

(10) Patent No.: US 6,736,208 B2
(45) Date of Patent: May 18, 2004

(54) WELLHEAD PRODUCTION PUMPING TREE WITH ACCESS PORT

(75) Inventors: Daniel J. Riddell, Edmonton (CA); Kwong-Onn Chan, Edmonton (CA)

(73) Assignee: Stream-Flo Industries LTD, Edmonton (CA)

( * ) Notice: Subject to any disclaimer, the term of this patent is extended or adjusted under 35 U.S.C. 154(b) by 0 days.

(21) Appl. No.: 10/128,406

(22) Filed: Apr. 23, 2002

(65) Prior Publication Data

US 2003/0196792 A1 Oct. 23, 2003

(51) Int. Cl.[7] ..... E21B 34/02
(52) U.S. Cl. ..... 166/88.4; 166/65.1
(58) Field of Search ..... 166/65.1, 88.4, 166/75.13, 93.1, 95.1, 97.1

(56) References Cited

U.S. PATENT DOCUMENTS 3,050,126 A * 8/1962 LeBeaux et al. ..... 166/97.1
3,437,149 A * 4/1969 Cugini et al. ..... 166/88.1
4,154,302 A * 5/1979 Cugini ..... 166/65.1
4,804,045 A * 2/1989 Reed ..... 166/65.1
5,544,707 A * 8/1996 Hopper et al. ..... 166/382
5,873,415 A * 2/1999 Edwards ..... 166/344
5,992,527 A * 11/1999 Garnham et al. ..... 166/88.4
6,062,314 A * 5/2000 Nobileau ..... 166/88.4
6,176,316 B1 * 1/2001 Hart ..... 166/368
6,302,212 B1 * 10/2001 Nobileau ..... 166/88.4
6,457,530 B1 * 10/2002 Lam et al. ..... 166/88.4
6,470,968 B1 * 10/2002 Turner ..... 166/348

FOREIGN PATENT DOCUMENTS

CA 2197584 A * 4/1997 ..... E21B/33/06

* cited by examiner

*Primary Examiner*—David Bagnell
*Assistant Examiner*—Brian Halford
(74) *Attorney, Agent, or Firm*—Dennis T. Griggs

(57) ABSTRACT

In an integral production pumping tree, the bottom connection, blow-out preventer, flow tee and top connection are positioned to one side, with the vertical rod bore off-center. Up to three vertical ports are provided in the other side of the tree, for providing access to the production casing bore for an electric heating string, an instrumentation string and a small diameter injection tubing string. The ports accommodate sealed connection assemblies, from which the strings extend. The upper portion of the other side of the tree is cut away to create space for introducing the connecting assemblies. The tubing hanger is provided with matching bores.

11 Claims, 4 Drawing Sheets

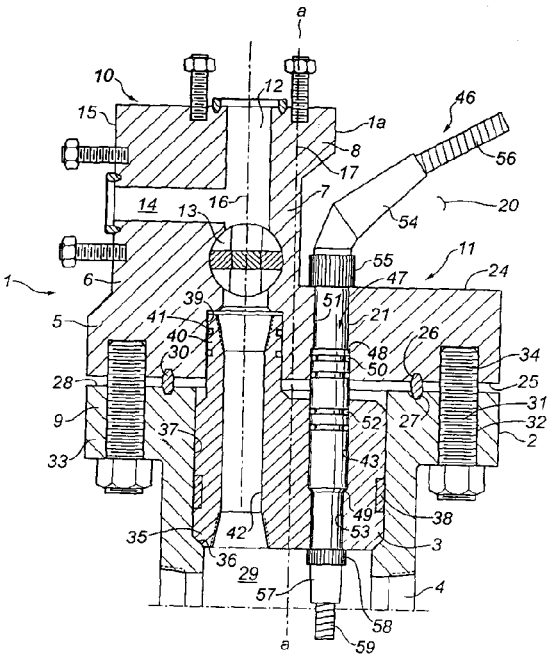

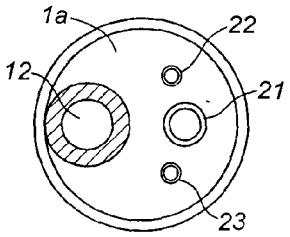

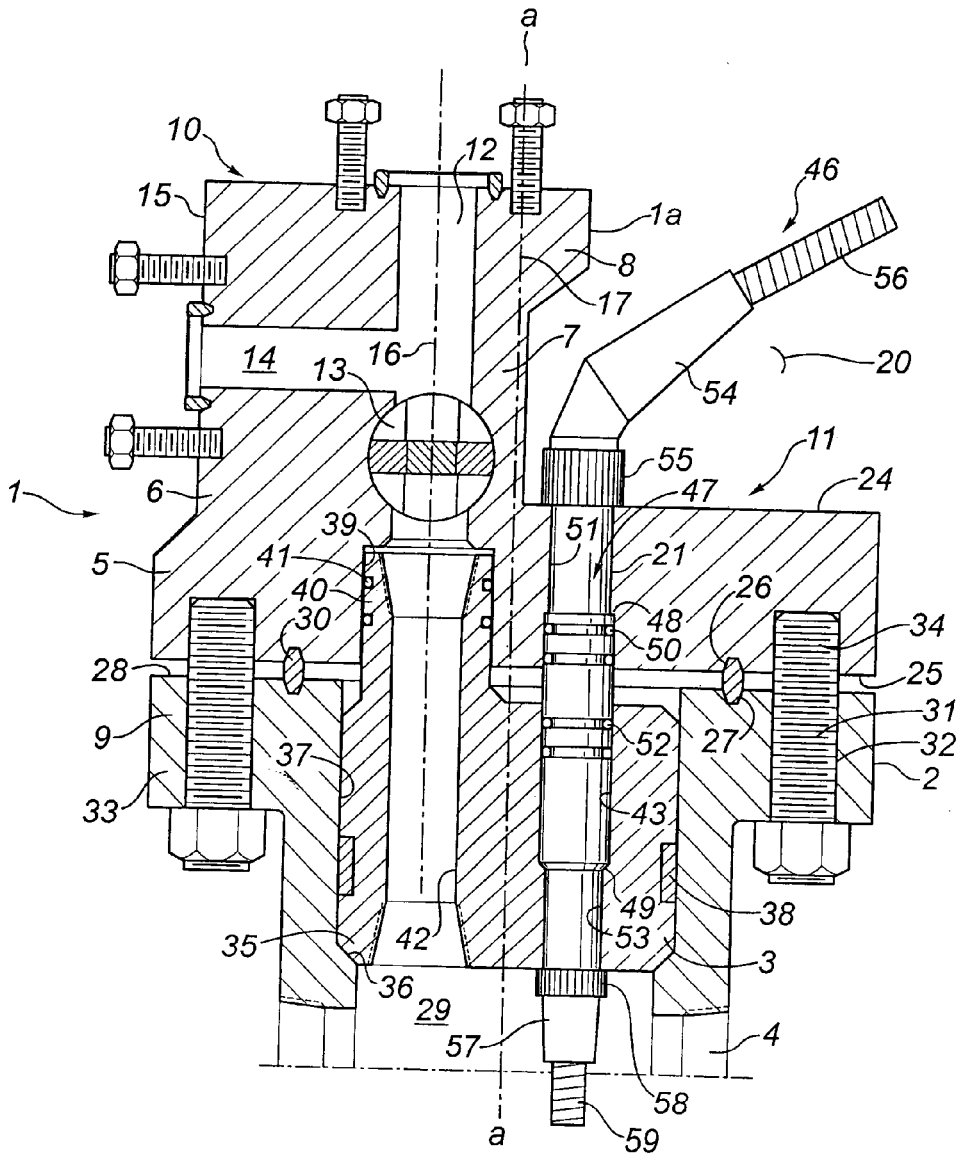

U.S. Patent May 18, 2004 Sheet 1 of 2 6,736,208 B2